US008402698B1

(12) United States Patent
Wang

(10) Patent No.: US 8,402,698 B1
(45) Date of Patent: Mar. 26, 2013

(54) MULTILEVEL BUILDING WITH SLOPED DRIVEWAY

(76) Inventor: Johann D. Wang, Studio City, CA (US)

( * ) Notice: Subject to any disclaimer, the term of this patent is extended or adjusted under 35 U.S.C. 154(b) by 0 days.

(21) Appl. No.: 13/545,975

(22) Filed: Jul. 10, 2012

(51) Int. Cl.
*B66B 9/00* (2006.01)
*E04H 6/06* (2006.01)

(52) U.S. Cl. ..... 52/30; 52/29

(58) Field of Classification Search ..... 52/29, 30
See application file for complete search history.

(56) References Cited

U.S. PATENT DOCUMENTS

| | | | | | |
|---|---|---|---|---|---|
| 902,898 | A | * | 11/1908 | Newhall | 52/27 |
| 2,936,083 | A | | 5/1960 | Dahlman | |
| 3,290,837 | A | | 12/1966 | Weston | |
| 3,440,781 | A | * | 4/1969 | Lott | 52/175 |
| 3,824,752 | A | * | 7/1974 | Weston | 52/176 |
| 4,424,651 | A | * | 1/1984 | Lee et al. | 52/175 |
| 4,790,531 | A | * | 12/1988 | Matsui et al. | 472/90 |
| 4,971,505 | A | | 11/1990 | Sawyer | |
| 1,432,132 | A | | 10/1992 | Sturges | |
| 5,749,186 | A | | 5/1998 | Kaufman et al. | |
| 6,209,270 | B1 | | 4/2001 | Johnston | |
| 6,405,496 | B1 | * | 6/2002 | Stewart et al. | 52/185 |
| D486,237 | S | * | 2/2004 | Henry | D25/1 |
| 7,048,092 | B2 | * | 5/2006 | Gomes Junior | 182/48 |
| 2004/0237421 | A1 | * | 12/2004 | Franz | 52/79.1 |

* cited by examiner

*Primary Examiner* — Mark Wendell
(74) *Attorney, Agent, or Firm* — QuickPatents; Kevin Prince

(57) ABSTRACT

A housing structure for erecting on a ground surface includes a generally helical ramp having at least two lanes for accommodating vehicular traffic in opposing directions, a loop at the highest level of the ramp connecting the at least two lanes. The ramp includes a plurality of habitable units, each at one of a plurality of radial positions with respect to a center of the ramp. The habitable units that share any particular radial position but that are vertically offset are each generally vertically co-aligned in a common multi-level building. In one embodiment, at least one habitable unit includes more than one floor or story. Each habitable unit preferably comprises at least a private garage connected to the ramp with a driveway, and a private living space that may include a rear balcony connected to a front porch by a breezeway.

11 Claims, 4 Drawing Sheets

MULTILEVEL BUILDING WITH SLOPED DRIVEWAY

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to dwelling structures, and more particularly to a novel stacked townhome design that is directly car-accessible.

DISCUSSION OF RELATED ART

Residential buildings such as single family homes, apartment buildings, townhomes, condominiums, and the like have undergone constant evolution over time as housing requirements for people in various location and environments have changed. As such building have evolved, certain beneficial features have become popular, and even in some cases standard.

For example, many housing tracts include a plurality of cul-de-sacs, which are popular because typically only residents drive such streets and excess traffic is minimized. As such, less vehicle noise is experienced by people living on such a street, and speeding is curtailed, leading to safer conditions. Further, residents of such streets often enjoy a closer neighborly bond, often being more observant of strangers and more easily being able to look out for each other's property, and the like.

As another example, condominiums and townhomes have become popular due to their reduced costs. However, one drawback of conventional condominiums, wherein each habitable unit is located on a single level, is that parking for the upper level units is necessarily located on the first level away from the condominium building, making such parking inconvenient. Most townhomes, on the other hand, since they utilize all levels of a building at a particular location, include a parking garage on their first level. However, such townhomes are accordingly not stacked, and as such the number of levels in each unit, and therefore in the entire building, are limited in practice to two or three. Further, such an arrangement is limited by the available land, and as such is a low-density solution.

The standard sloping floor parking garage typically contains two adjacent parking modules tilted in opposite directions with cross-aisles at each end so that vehicles traveling the length of both aisles make a 360 degree turn to move up or down one complete parking level (as detailed in *Time-Saver Standards for Building Types/3rd Edition* by Joseph De Chiara and John Hancock Callender 3rd ed. p924, McGraw-Hill, 1990, ISBN 0-07-016279-4). This design has a sloped floor of 3 to 5 percent to permit comfortable parking and pedestrian walking. This design has been used exclusively for parking purpose with no known attempt to integrate multiple personal occupancy spaces in its system.

The most successful prior art design that address the issue of allowing direct access to residential units in a high-density development is presented by Hugh W. Johnston in U.S. Pat. No. 6,209,270. His ascending method is by a helical ramp discrete from the main body of the structure, which requires considerable additional real estate and lengthens travel time from the ground floor to each unit. Further, such discrete ramps have a difficult-to-camouflage parking garage appearance and give the impression that those living in such a structure live in a modified parking garage. Further, emergency and oversized vehicles often have difficulty with such one-lane ramp systems.

Other prior art designs provide differing solutions to providing parking closer to residential units, such as the following:

| U.S. Pat. No. | Inventor | Patent Date |
|---|---|---|
| 1,432,132 | Sturges | Oct. 17, 1922 |
| 3,290,837 | Weston | Dec. 13, 1966 |
| 3,824,752 | Weston | Jul. 23, 1974 |
| 5,749,186 | Kaufman et al. | May 12, 1998 |
| 2,936,083 | Dahlman | May 10, 1960 |
| 4,971,505 | Sawyer | Nov. 20, 1990 |

In each of these prior art designs, the resulting structure either does not provide for parking in a garage that is integral with or immediately adjacent to a residential unit, or presents the unsightly appearance of a modified parking garage.

Clearly, then, there is a need for a housing structure that combines the features and benefits of a cul-de-sac community, but that also benefits from the lowered costs associated with townhomes and condominiums in a high-density structure. Such a needed housing structure would provide for units on multiple levels, yet also provide for direct access parking in each habitable unit. The structure from outside would provide the appearance of a residential building or cluster of buildings. The present invention accomplishes these and other objectives.

SUMMARY OF THE INVENTION

The present device is a housing structure for erecting on a ground surface. The housing structure includes a generally helical ramp. The ramp preferably includes at least two marked or otherwise indicated lanes for accommodating vehicular traffic in opposing directions, a loop at the highest level of the ramp connecting the at least two lanes The ramp may further include a plurality of guest parking spaces and at least one elevator. At least one stairway is included for pedestrian convenience and evacuation purposes in case of fire, for example.

The ramp includes a plurality of habitable units, each at one of a plurality of radial positions with respect to a center of the ramp. The habitable units that share any particular radial position but that are vertically offset are each generally vertically co-aligned in a common multi-level building. Such stacks of habitable units combined in a common multi-level building may include at least two laterally adjacent habitable units per level. In one embodiment, at least one habitable unit is a two-story habitable unit, or even a three-story habitable unit, particularly on the highest level of the ramp.

Each habitable unit preferably comprises at least a private garage and a private living space. The garage is connected to the ramp with a driveway. As such, each habitable unit may be accessed by vehicle directly, without the need to park at a lower level and take an elevator or stairs as with prior art apartment or condominium buildings, for example. Further, each habitable unit may include a balcony oriented away from the ramp, as well as a breezeway connected to a front porch between at least one laterally-adjacent habitable unit.

Preferably the lowest level of the ramp is coincident with the ground surface, and the highest level of the ramp terminates in the loop. The structure may include access control systems at the lowest level, as well as fire safety enclosures, devices and systems. A basement level may further be included for storage, additional or oversized parking, or the like. The structure may further include security systems, landscaping, lighting systems, communications systems, utility lines, sewage systems, and the like as necessary.

The present invention is a housing structure that combines the features and benefits of a cul-de-sac community, but that also benefits from the lowered costs associated with townhomes and condominiums in a high-density structure. The present structure provides for habitable units on multiple levels, yet also provide for direct access parking in each habitable unit. The structure from outside presents the appearance of a residential building or cluster of buildings, as opposed to that of a parking garage. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
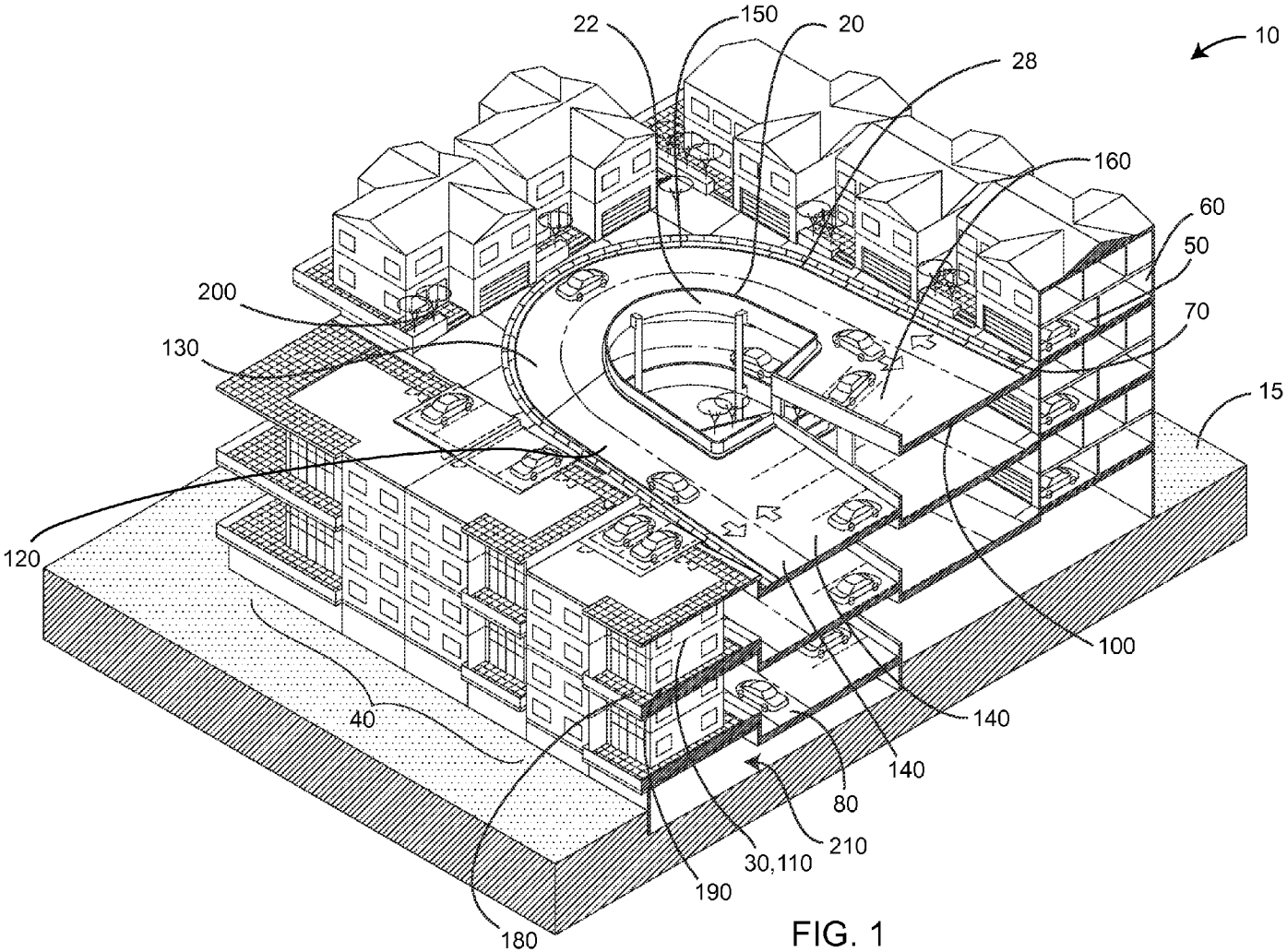
FIG. 1 is a partial perspective cut-away view of the housing structure of the invention.
Figure 3:
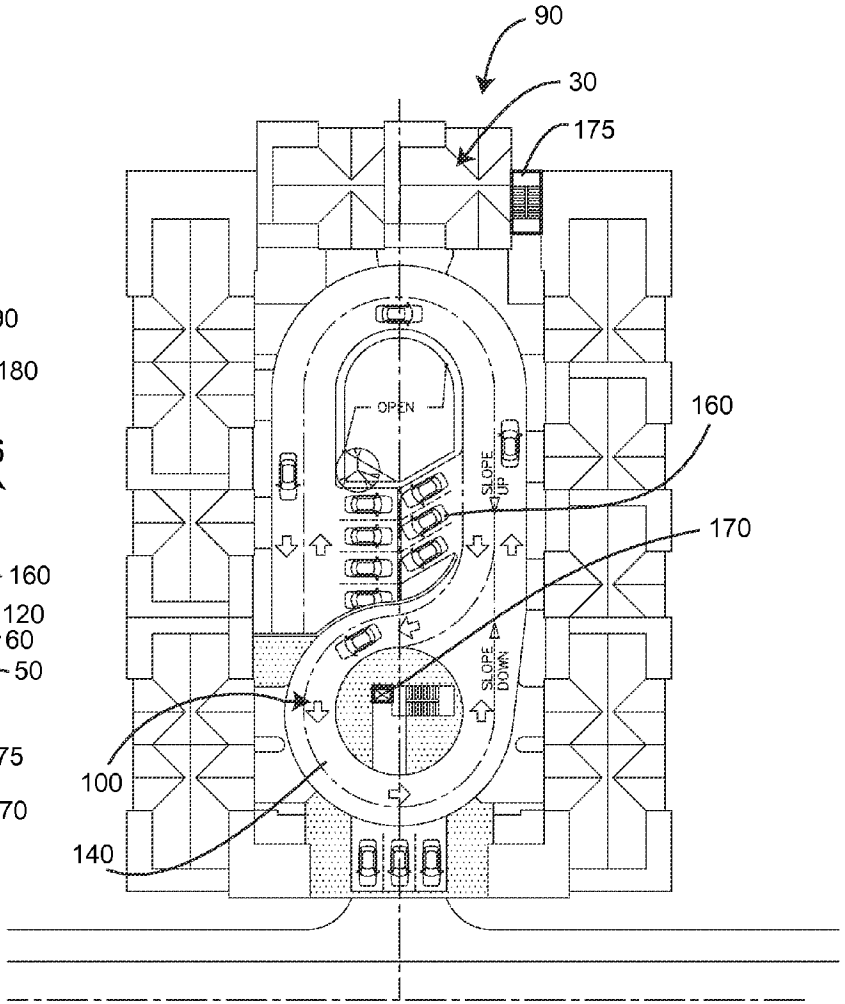
FIG. 3 is a top plan view of a highest level of the invention.
Figure 2:
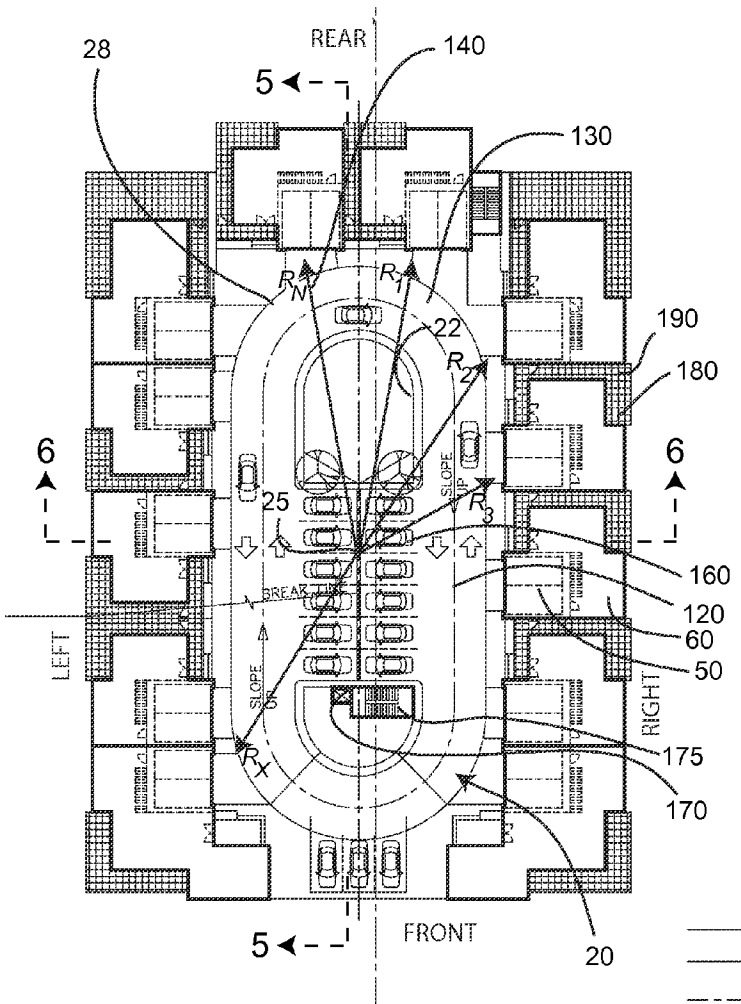
FIG. 2 is a top plan view of the invention, illustrating a typical level thereof.
Figure 4:
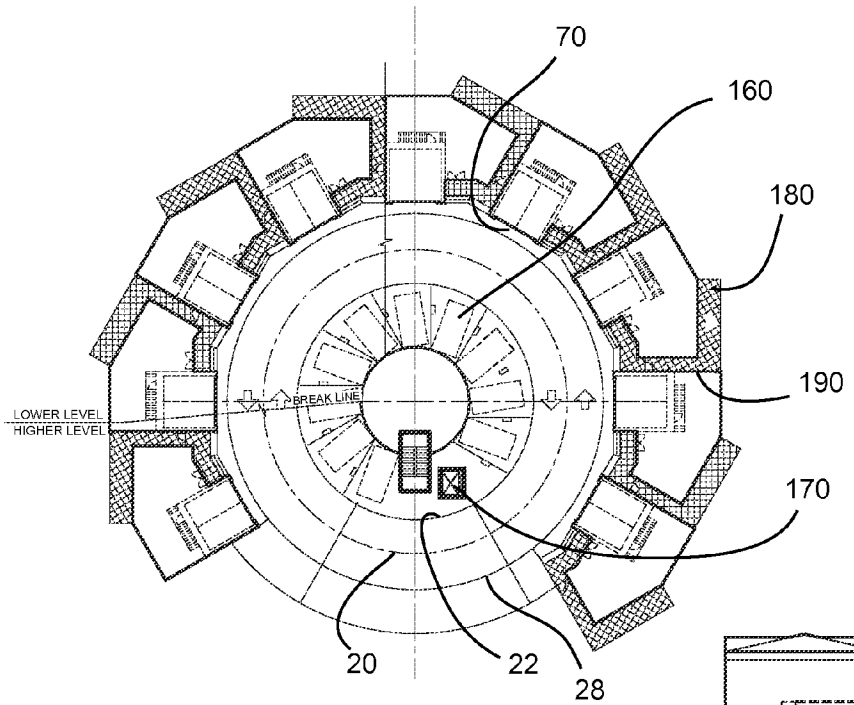
FIG. 4 is a top plan view of a typical level of an alternate embodiment of the invention.

FIGS. 1-3 illustrate a housing structure 10 for erecting on a ground surface 15. The housing structure 10 includes a generally helical ramp 20 that has an inner edge 22 and an outer edge 28. In a preferred embodiment the ramp 20 may include a plurality of straight sections 120 each interconnected with curved sections 130 (FIG. 1), providing open natural lighting to all levels, or in an alternate embodiment the ramp 20 may be a generally continuously curved (FIG. 4). The ramp 20 is generally sloped along its entire length at no more than 3 to 7%, allowing ease of walking and driving, although it may include areas sloped at different relative gradients as necessary. The ramp 20 is constructed of concrete or other suitably rigid, strong, and durable material or combination of materials.

The ramp 20 preferably includes at least two marked or otherwise indicated lanes 140 for accommodating vehicular traffic in opposing directions (FIGS. 1-3), a loop 100 at the highest level 90 of the ramp 20 connecting the at least two lanes 140. In one embodiment, the ramp 20 further includes a sidewalk 150 (FIG. 1) adjacent the outer edge 28 for accommodating pedestrian traffic throughout the structure 10.

The ramp 20 may further include a plurality of guest parking spaces 160 (FIGS. 1-3) and at least one elevator 170, preferably at the inner edge 22 thereof. The elevator 170 may be a passenger elevator 170, a vehicle elevator (not shown), or a freight elevator (not shown), or a mixture thereof, for example, at either end of the structure 10. At least one stairway 175 is included for pedestrian convenience and evacuation purposes in case of fire, for example (FIGS. 2 and 3).

Figure 6:
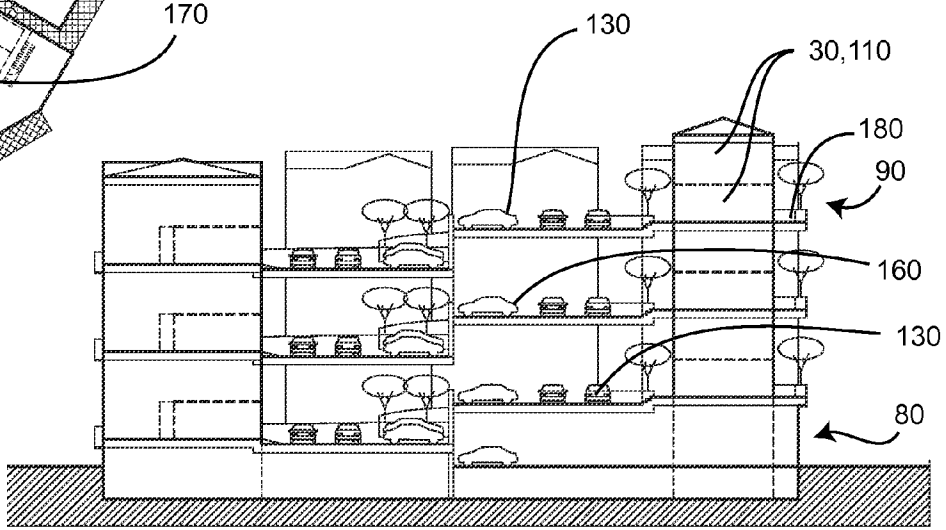
FIG. 6 is a cross-sectional view of the invention, taken generally alone lines 6-6 of FIG. 2.
Figure 7:
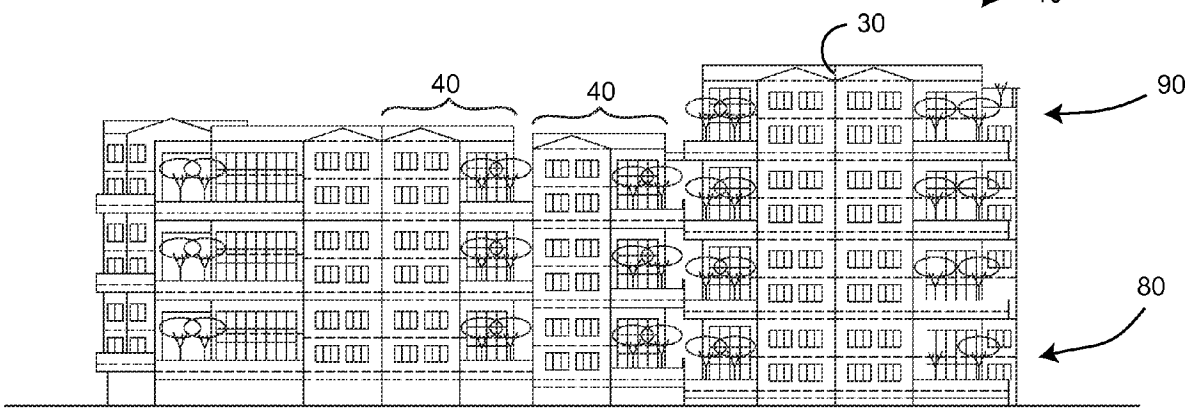
FIG. 7 is a side elevational view of the invention.

The outer edge 28 includes a plurality of habitable units 30, each at one of a plurality of radial positions $R_n$ with respect to a center 25 of the ramp 20. The habitable units 30 that share any particular radial position $R_x$ but that are vertically offset are each generally vertically co-aligned in a common multi-level residential building 40 (FIGS. 1, 2 and 7). Such stacks of habitable units 30 combined in a common multi-level residential building 40 may include at least two laterally adjacent habitable units 30 per level (FIG. 1). In one embodiment, at least one habitable unit 30 is a two-story habitable unit 110 (FIG. 6), or even a three-story habitable unit (not shown), particularly on the highest level 90.

Each habitable unit 30 comprises at least a private garage 50 and a private living space 60. The garage 50 is connected to the ramp 20 with a driveway 70, the driveway 70 being sloped and possibly warped as necessary to allow a vehicle to drive between the ramp 20 and the garage 50. As such, each habitable unit 30 may be accessed by vehicle directly, without the need to park at a lower level and take an elevator or stairs as with prior art apartment or condominium buildings (not shown), for example. Further, each habitable unit 30 may include a balcony 180 oriented away from the ramp 20 (FIG. 1), as well as a breezeway 190 connecting each patio 180 with the ramp 20 between at least one laterally-adjacent habitable unit 30. A front porch 200, preferably raised with respect to the sidewalk 150, may also be included with each habitable unit 30, such a porch 200 being connected to the balcony along the breezeway 190.

Figure 5:
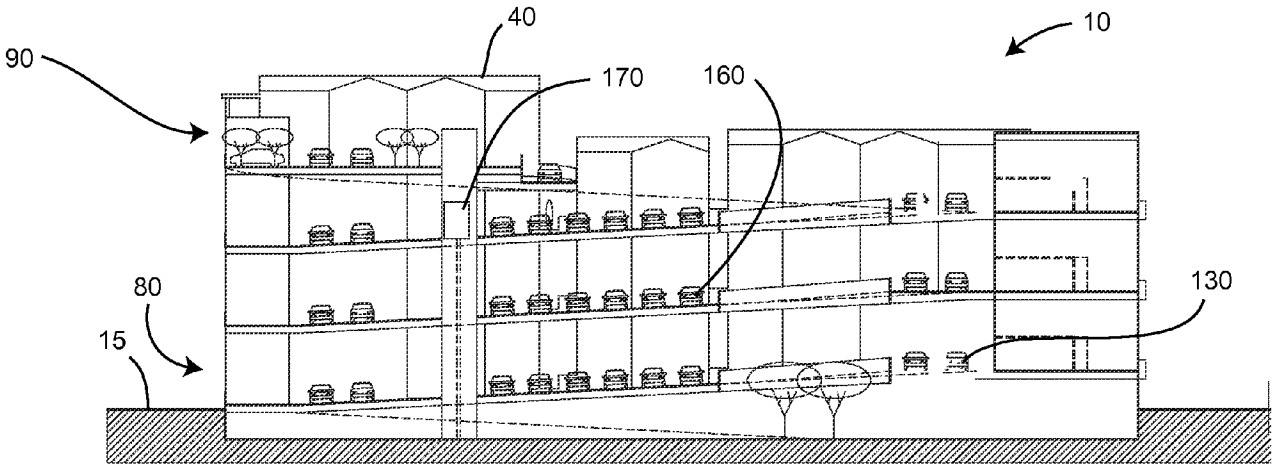
FIG. 5 is a cross-sectional view of the invention, taken generally alone lines 5-5 of FIG. 2.

Preferably the lowest level 80 of the ramp 20 is coincident with the ground surface 15 (FIG. 5), and the highest level 90 of the ramp 20 terminates in the loop 100 (FIG. 3). The structure 10 may include access control systems (not shown) at the lowest level 80, as well as fire safety enclosures, devices and systems (not shown). A basement level 210 may further be included for storage, additional or oversized parking, or the like. The structure 10 may further include security systems, landscaping, lighting systems, communications systems, utility lines, sewage systems, and the like as necessary (not shown). While the habitable units 30 are illustrated as being residential units, such habitable units 30 may also be hotel suites, medical offices, office or retail space, or the like. Likewise, the habitable units 30 on the lowest level 80 may be retail or office space, while the habitable units 30 on higher levels may be residential.

While a particular form of the invention has been illustrated and described, it will be apparent that various modifications can be made without departing from the spirit and scope of the invention. For example, substantially four levels are illustrated in the drawings, but a varying number of levels could be accommodated. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A housing structure for erecting on a ground surface, comprising:

a generally helical ramp having an inner edge and an outer edge, the outer edge including a plurality of habitable units arrayed around the helical ramp, the array enveloping the helical ramp, each habitable unit at one of a plurality of radial positions with respect to a center of the ramp, the habitable units that share radial positions but that are vertically offset each being generally vertically co-aligned in a common multi-level residential building, each habitable unit comprising at least a garage and a living space, the garage connected to the ramp with a driveway, the ramp at a lowest level being coincident with the ground surface and at the highest level terminating in a loop.

2. The housing structure of claim 1 wherein each habitable unit is a two-story habitable unit.

3. The housing structure of claim 1 wherein the ramp comprises a plurality of straight sections each interconnected with curved sections.

4. The housing structure of claim 1 wherein the ramp is generally continuously sloped.

5. The housing structure of claim 1 wherein at least one of the common multi-level residential buildings includes at each level thereof at least two laterally adjacent habitable units.

6. The housing structure of claim 1 wherein the ramp includes two lanes for accommodating vehicular traffic in opposing directions, and wherein the loop at the highest level of the ramp connects the two lanes.

7. The housing structure of claim 6 wherein the ramp further includes a sidewalk adjacent the outer edge for accommodating pedestrian traffic throughout the structure.

8. The housing structure of claim 1 wherein the inner edge further includes a plurality of guest parking spaces.

9. The housing structure of claim 1 wherein the ramp arrangement further includes an elevator at the inner edge of the ramp.

10. The housing structure of claim 1 wherein each habitable unit further includes a balcony oriented away from the ramp.

11. The housing structure of claim 10 wherein each habitable unit further includes a breezeway connecting each patio with the ramp between at least one laterally-adjacent habitable unit.

* * * * *